US005806321A

United States Patent [19]

Bendtsen et al.

[11] Patent Number: 5,806,321

[45] Date of Patent: Sep. 15, 1998

[54] METHOD FOR DEFROSTING A REFRIGERATION SYSTEM AND CONTROL APPARATUS FOR IMPLEMENTING THAT METHOD

[75] Inventors: Christian Bendtsen, Sydals; Frede Schmidt, Sønderborg, both of Denmark

[73] Assignee: Danfoss A/S, Nordborg, Denmark

[21] Appl. No.: 836,657

[22] PCT Filed: Nov. 2, 1995

[86] PCT No.: PCT/DK95/00433

§ 371 Date: May 2, 1997

§ 102(e) Date: May 2, 1997

[87] PCT Pub. No.: WO96/14546

PCT Pub. Date: May 17, 1996

[30] Foreign Application Priority Data

Nov. 3, 1994 [DE] Germany ..... 44 38 917.5

[51] Int. Cl.[6] ..... F25D 21/00

[52] U.S. Cl. ..... 62/80; 62/155; 62/234

[58] Field of Search ..... 62/155, 156, 152, 62/234, 154, 185, 80, 81, 82

[56] References Cited

U.S. PATENT DOCUMENTS

| | | | |
|---|---|---|---|
| 2,349,671 | 5/1944 | Newton | 62/151 |
| 3,643,458 | 2/1972 | Linstromgerg et al. | 62/155 |
| 3,890,798 | 6/1975 | Fujimoto et al. | 62/155 |
| 4,530,217 | 7/1985 | Alluto et al. | 62/156 |
| 5,315,835 | 5/1994 | Park | 62/155 X |

FOREIGN PATENT DOCUMENTS

| | | | |
|---|---|---|---|
| 4-332358 | 11/1992 | Japan | 62/152 |

*Primary Examiner*—Harry B. Tanner
*Attorney, Agent, or Firm*—Lee, Mann, Smith, McWilliams, Sweeney & Ohlson

[57] ABSTRACT

A method for defrosting a refrigeration system makes provision for partial defrosting of the cooling surface to be carried out at relatively short intervals, and for full defrosting to be carried out at longer intervals. To that end an associated control unit has four timers which determine the switching on and switching off times of the defrosting processes. In this manner the interval between successive full defrostings can be considerably increased.

12 Claims, 4 Drawing Sheets

T(°C)
10
5
0
-5
-10
t
A
B
C
D
49
50
a
b
c
d
ON
Off

METHOD FOR DEFROSTING A REFRIGERATION SYSTEM AND CONTROL APPARATUS FOR IMPLEMENTING THAT METHOD

BACKGROUND OF THE INVENTION

The invention relates to a method for defrosting a refrigeration system, in which a supply arrangement supplies at least one cooling surface with refrigerant and as required a defrosting process is initiated at specific intervals; for implementing the method, the invention also relates to a control unit for a refrigeration system having at least one cooling surface, the unit having an output for switching on and switching off a flow of refrigerant passing through the cooling surface in dependence on the refrigerating chamber temperature.

Such a method and control apparatus are known, for example, from DE 40 06 468 C1. A refrigerator thermostat controls the switching on and off of a compressor (on-off operation). The thermostat switches the compressor off at a lower limit temperature and does not switch it on again until the cooling surface (evaporator) of the refrigerator reaches an upper limit value, which normally lies in the positive temperature range. In this mode of operation a heavy formation of frost or ice is not expected, so that there is no need for enforced defrosting. If, however, the refrigerator is set to a low temperature and, for example, is heavily overburdened as a result of frequent opening of the door or the placing of a large quantity of goods in the refrigerator for cooling, the lower limit temperature is not reached, and the compressor runs continuously for a very long period which leads to the formation of frost and ice on the cooling surface. For that reason a timer is provided, which switches the compressor off after a fixed time and carries out enforced full defrosting. The temperature in the refrigerator rises for a short time during this defrosting. This is tolerated, however, because otherwise with an iced-up evaporator an elevated temperature would occur constantly because of the insulation effect of the iced-up evaporator.

Similar problems arise with other known refrigeration systems too, in which defrosting has to be carried out from time to time because refrigerant is supplied to the cooling surface constantly or at least for relatively long periods of time.

SUMMARY OF THE INVENTION

The invention is based on the problem of being able to carry out de-icing of the cooling surface by defrosting at longer intervals than previously, wherein it is also possible for convenient times for defrosting to be selected.

That problem is solved by the method according to the invention in that partial defrosting is carried out at relatively short intervals and full defrosting is carried out at longer intervals.

Partial defrosting is effected when a layer of frost has formed on the cooling surface. It is caused by the temperature of the cooling surface assuming a value above zero for a short time. The frost layer is not removed in this process. On the contrary, it is converted into a solid layer of ice by fusing of a substantial part of the ice crystals. This layer is a much better conductor of heat than the layer of frost and takes up considerably less volume. This is especially important if the cooling surface has fins between which air flows, the quantity of air being substantially reduced by an increasingly thicker layer of frost but not by this solid ice layer. As operation continues, additional frost forms on the solid ice, and in turn can be converted into solid ice by partial defrosting. The refrigeration system can therefore continue normal operation for a relatively long time before full defrosting has to be carried out.

The efficiency of the refrigeration system is high. Firstly, with partial defrosting the cooling surface is brought only for a short time to a low positive temperature value. Secondly, the layer of ice to be thawed on the cooling surface assists in largely maintaining the desired temperature during the defrosting period.

It has proved beneficial for the shorter intervals to be from one to two hours. In this way the layer of frost has still not achieved a substantial insulating effect before the frost melts partially.

On the other hand, it is advisable for the longer intervals to be eighteen to thirty hours. Experience has shown that only after this time have the several partial defrostings caused the ice layer to build up to such thickness that it must be removed in order to avoid malfunctioning.

For full defrosting it is especially advantageous to select a period in which the refrigeration system is normally least loaded. The increase in the refrigerating chamber temperature tolerated during full defrosting can therefore very quickly be restored to the desired value. In the case of refrigerators in shops and supermarkets, defrosting is expediently carried out at night. At that time no new goods for cooling are being loaded into the refrigerators. The refrigerating chamber does not need to be open for improved accessibility. Even open freezer chests can be covered with insulating panels. Since a twenty-four hour rhythm can be kept to for complete defrosting, it is possible to carry out defrosting every day at the same time. Defrosting at maximum load can therefore be avoided.

The interval between two defrosting processes is expediently dependent on operating parameters of the refrigeration system. The interval between partial or full defrosting processes can thus be fixed in an optimum manner. These operating parameters include those that allow prediction of the thickness of the frost or ice layer, for example, the number of times the door is opened or the increase in the resistance to air during circulation of cooling air.

Operating parameters can also be used to determine the duration of the defrosting period, above all those parameters which enable the end of the defrosting process to be recognized. In particular, the duration of the defrosting processes can be dependent on the temperature of the refrigerating chamber. The end of the defrosting process is distinguished by a slight further temperature rise. In addition, the refrigerating chamber thermostat, normally already present, can be used for that purpose.

An especially simple solution is obtained when defrosting is effected by interrupting the supply of refrigerant to the cooling surface. The latent heat in the goods to be cooled and in the environment then leads to an increase in temperature in the refrigerating chamber, so that partial or full defrosting is carried out. This interruption can be brought about by stopping the supply arrangement, such as a compressor or pump, by actuating a valve, or by other means.

If pulse-width controlled valves are used in the refrigerant circuit it is then advisable to determine the duration of the defrosting processes by extending the "off" time. The switching on and switching off function of such a valve is here used for defrosting purposes.

Another preferred solution consists in monitoring the "on" time of the supply arrangement and when the shorter interval has been exceeded the supply arrangement is stopped until partial defrosting has been achieved.

When using a refrigerant system having several cooling surfaces and continuous supply of refrigerant, a further preferred possibility consists in interrupting the supply to each cooling surface in succession until partial defrosting has been effected. As the individual cooling surfaces are disconnected in succession from the supply of refrigerant, optimum operation is achieved. The refrigerating chamber temperature is only very slightly influenced by the partial defrosting.

In a further embodiment, in a refrigeration system having a secondary circuit with several cooling surfaces, the refrigerant of which is cooled by a primary circuit, provision is made for partial defrosting to be effected by interrupting the secondary refrigerant flow to one or more cooling surfaces. The primary circuit can operate, for example, with ammonia, and the secondary circuit with saline solution.

The problem posed is solved according to the invention using apparatus comprising a first switch-off timer which determines the shorter interval between the start of partial defrosting and the end of the previous defrosting, a second switch-off timer which determines the longer interval between the start of full defrosting and the end of the previous full defrosting, a first switch-on timer which determines the shorter duration of partial defrosting and a second switch-on timer which determines the longer duration of full defrosting. By means of the four timers, the desired partial defrosting and full defrosting can be carried out at the correct time.

It is advisable here to set the two switch-off timers to fixed times. The two switch-on timers on the other hand can respond to operating parameters of the refrigeration system.

BRIEF DESCRIPTION OF THE DRAWING

The invention is explained in greater detail hereinafter with reference to preferred embodiments illustrated in the drawings, in which.

DESCRIPTION OF THE PREFERRED EMBODIMENTS

Figure 1:
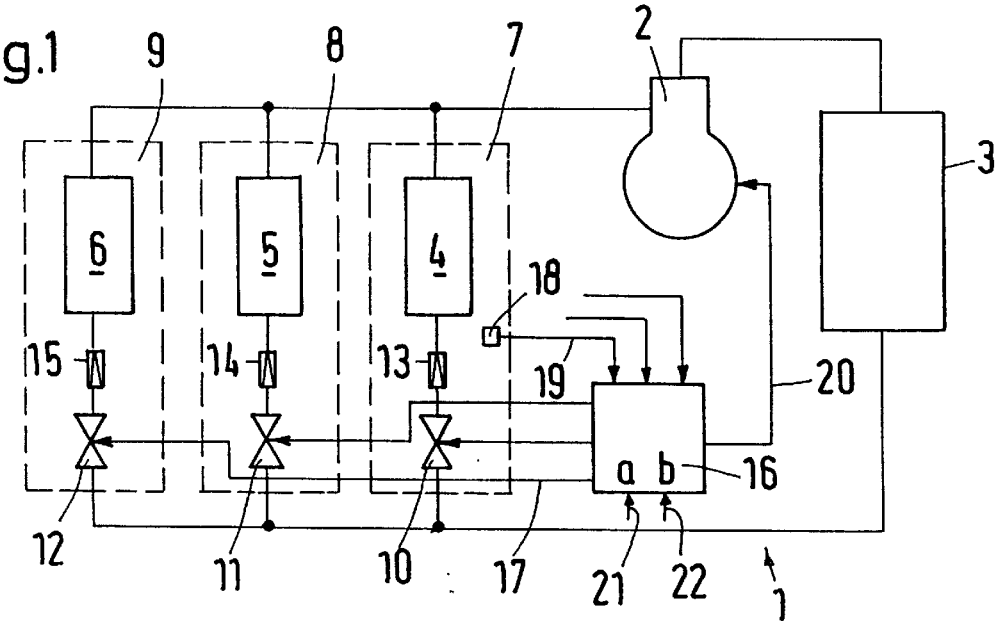
FIG. 1 shows diagrammatically a defrostable refrigeration system according to the invention.

FIG. 1 shows a refrigeration system 1 having a compressor 2, which supplies a refrigerant under high pressure at high temperature to a condenser 3. In the condenser 3 the refrigerant is cooled and following this cooling the refrigerant gas is converted into liquid. The condenser 3 feeds three evaporators 4, 5 and 6 connected in parallel, each being arranged in a respective refrigerating chamber 7, 8 and 9. Connection is effected by way of a respective valve 10, 11, 12 and a respective throttle element 13, 14, 15. The latter can be in the form of a capillary tube or expansion valve.

A control unit 16 controls the valves 10 to 12 by way of signal lines 17 in dependence on the refrigerating chamber temperature, for which purpose in each refrigerating chamber 7, 8, 9 there is provided a refrigerating chamber temperature sensor 18 which is connected by way of a signal line 19 to the control unit 16. The compressor 2 is controlled by way of a signal line 20 in dependence on the overall requirement of the refrigeration system. A value a which determines the interval between the preceding defrosting and the following partial defrosting can be fed in through an input 21. A value b, which determines the interval between the preceding full defrosting and the following full defrosting, can be fed in through a second input 22. The duration of partial defrosting and full defrosting is determined in dependence on the temperature of the refrigerating chamber or other operating parameters.

Figure 2:
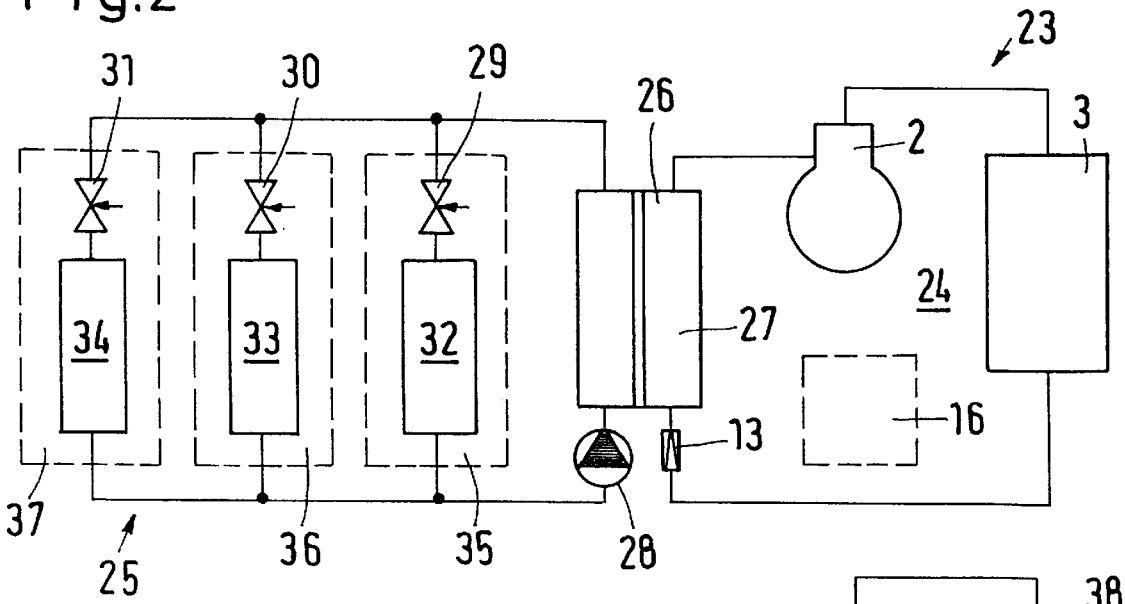
FIG. 2 shows another embodiment having primary and secondary circuits.

The refrigeration system 23 of FIG. 2 has a primary circuit 24, which is operated with ammonia, and a secondary circuit 25, which is operated with saline solution. The two circuits are connected to one another by way of a heat-exchanger 26. The primary circuit has a compressor 2, a condenser 3 and a throttle element 13, which is connected in series with an evaporator chamber 27 of the heat-exchanger 26. A pump 28 conveys the refrigerant, that is, the saline solution, by way of the secondary exchanger chamber of the heat-exchanger 26 and by way of the valves 29, 20 and 31 controlling the supply of refrigerant to cooling surfaces 32, 33 and 34, each of which is arranged in a respective refrigerating chamber 35, 36, 37. The associated control unit 16 is merely indicated. It controls the valves 29, 30 and 31 and the compressor 2 similarly to the manner of controlling the refrigeration system shown in FIG. 1.

Figure 3:
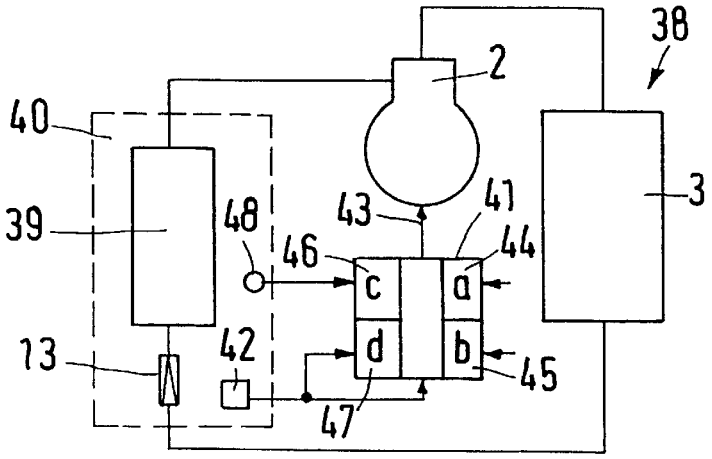
FIG. 3 shows a third embodiment, suitable for a domestic refrigerator.

FIG. 3 shows a refrigeration system 38 which is intended for a domestic refrigerator. Again, there is a compressor 2, a condenser 3 and connected thereto by way of a throttling element 13 a cooling surface 39 in the form of an evaporator in a refrigerating chamber 40. A control unit 41 operates similarly in dependence on a refrigerating chamber temperature sensor 42 and controls the compressor 2 by way of a signal line 43. The control unit 41 contains four timers 44, 45, 46 and 47. The first switch-off timer 44 determines the shorter interval a between the start of a partial defrosting and the end of the preceding defrosting, and this can be effected in dependence on the number of operations of a contact 48 operated when the door opens. The second switch-off timer 45 determines the longer interval b between the start of full defrosting and the end of the preceding full defrosting, for example, at twenty-four hours. The first switch-on timer 46 determines the shorter duration c of partial defrosting. The second switch-on timer 47 determines the longer duration d of full defrosting in dependence on the measurement signal of the refrigerating chamber temperature sensor 42. Partial defrosting commences only when the operating time of the compressor 2 exceeds the interval a.

Figures 4, 5, 6, 7:
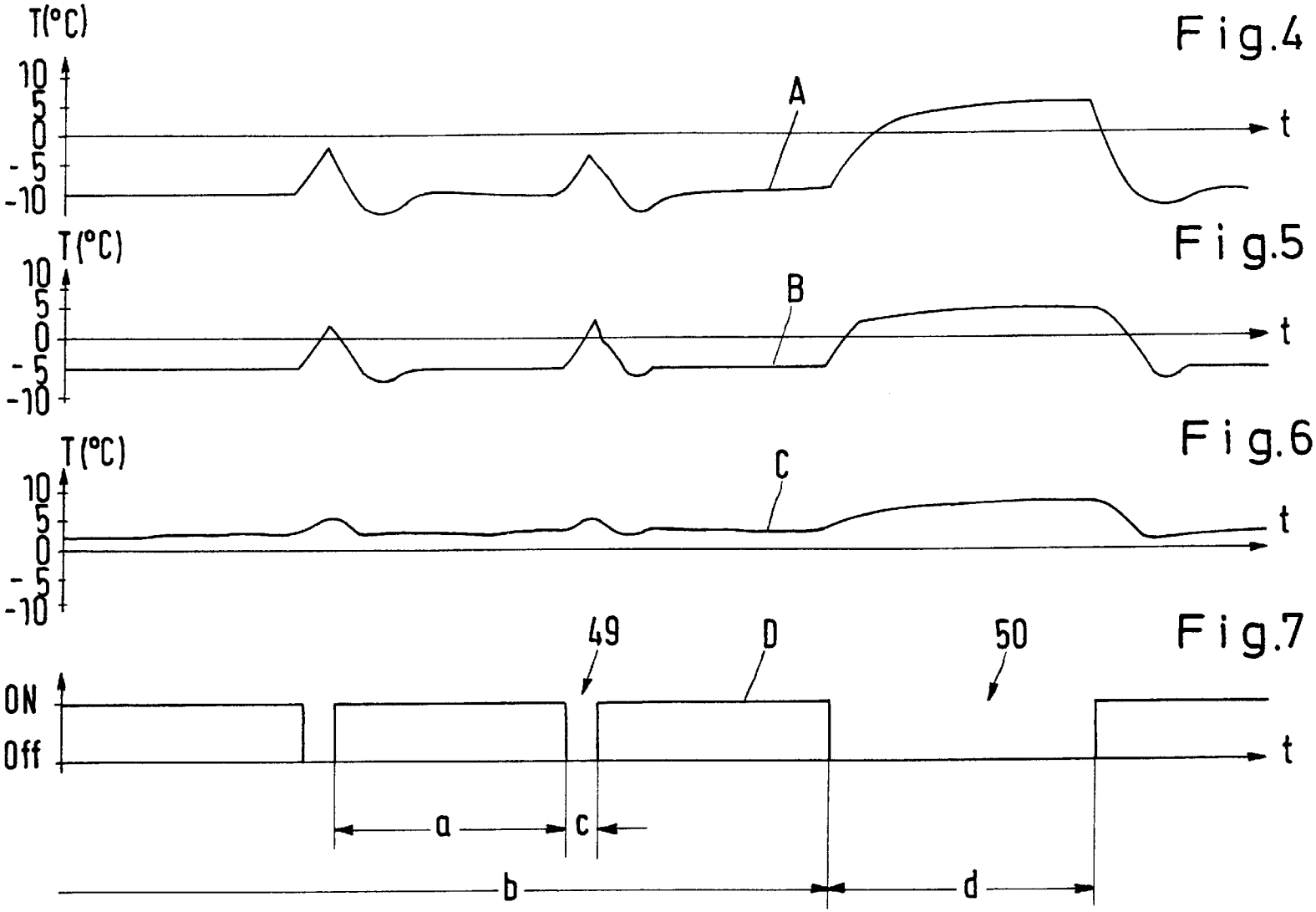
FIG. 4 shows the supply temperature of the refrigerant over time.
FIG. 5 shows the exit temperature of the refrigerant over time.
FIG. 6 shows the refrigerating chamber temperature over time.
FIG. 7 shows the on-off state of the refrigerant flow over time.

FIGS. 4 to 7 should be considered together. Curve A in FIG. 4 shows the temperature of the refrigerant on admission to the cooling surface, that is, for example, the evaporators 4, 5, 6 or 39 or the heat-exchangers 32, 33 and 34, over the time t. Curve B in FIG. 5 shows the temperature of the refrigerant on leaving the cooling surface over time. Curve C in FIG. 6 shows the refrigerating chamber temperature over time and curve D in FIG. 7 shows the on-off behaviour of refrigerant flow, such as that characteristic of the defrosting according to the invention, over time.

The short intervals 49 in FIG. 7 denote the time of partial defrosting during the period c. The large intervals 50 denote the duration of full defrosting during the period d. The start of partial defrosting lags behind the end of the preceding full defrosting by the interval a. The start of full defrosting lags behind the end of the preceding partial defrosting by the interval b. During period a the valves 10, 11, 12 and 29, 30, 31 are normally in operation. In the intervals 49 and 50 they are closed. Related to the compressor 2 in FIG. 3, the compressor is continuously operative during the intervals a and is switched off during intervals 49 and 50. If, however, because of the refrigerating chamber temperature control the compressor 2 has already been switched off before the interval a has elapsed, the enforced defrosting can be dispensed with.

During partial defrosting, the discharge temperature represented by curve B rises only briefly above zero. This does not significantly influence the refrigerating chamber temperature represented by curve C. During full defrosting, on the other hand, a larger temperature rise in these curves has to be tolerated. It is therefore of great advantage for full defrosting to be carried out only at very long intervals.

Figure 8:
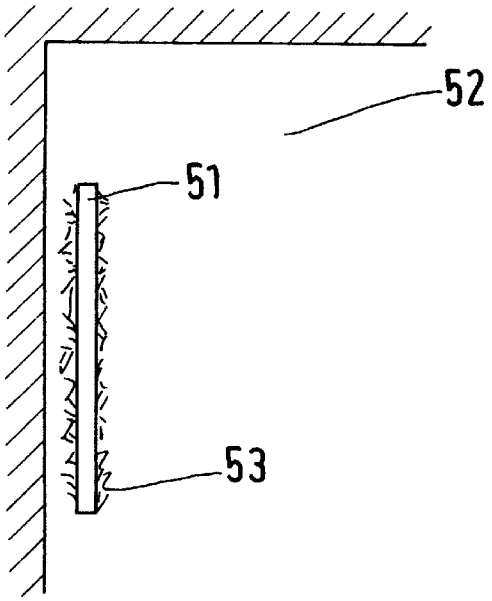
FIG. 8 shows a cooling surface with an initial formation of frost.
Figure 9:
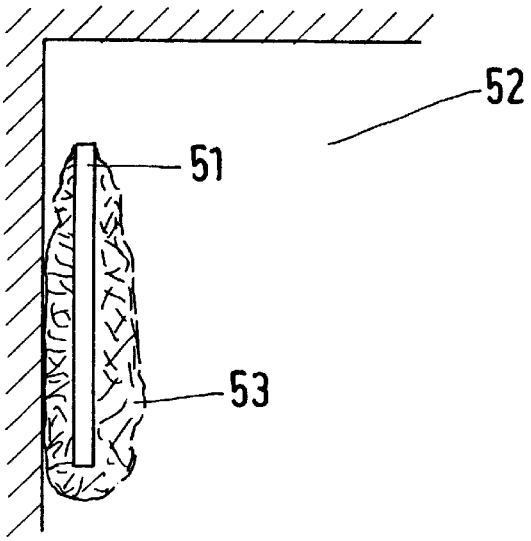
FIG. 9 shows the same cooling surface with an obstructive layer of frost.
Figure 10:
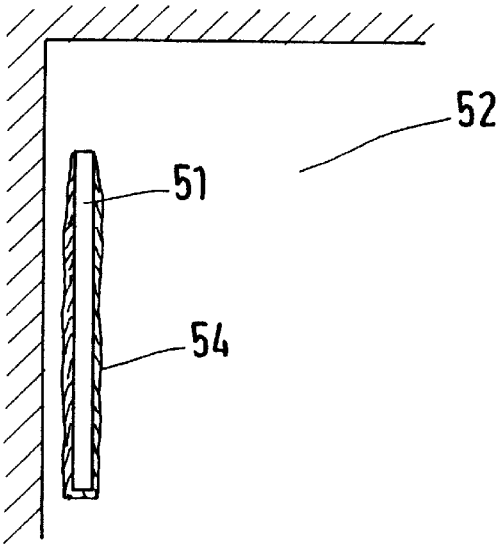
FIG. 10 shows the same cooling surface after partial defrosting.

FIGS. 8 to 10 show a cooling surface 51 through which refrigerant flows and which is arranged in a refrigerating chamber 52. In FIG. 8 this cooling surface 51 has the beginnings of a frost layer 53, which does not as yet interfere with operation. In FIG. 9, this frost layer 53 has reached a thickness which considerably hinders circulation of air along the cooling surface 51 and thus the exchange of heat. If partial defrosting is now carried out, the frost layer 53 melts partially and a layer of ice 54 is formed, as shown in FIG. 10. Only when that ice layer after several partial defrostings becomes too thick, is a full defrosting to be carried out.

Figure 11:
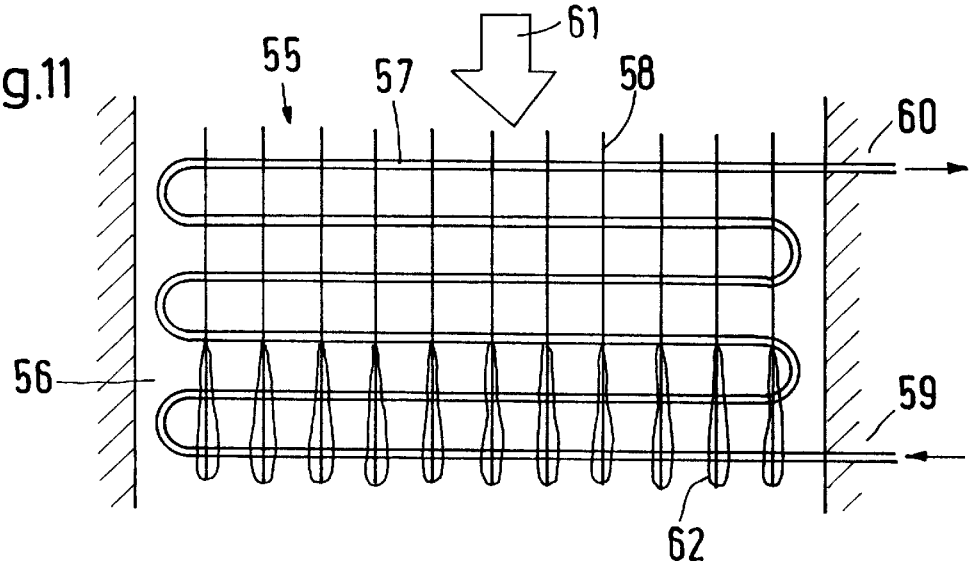
FIG. 11 shows a fin-type cooling surface operating with air circulation, with an initial formation of frost.
Figure 12:
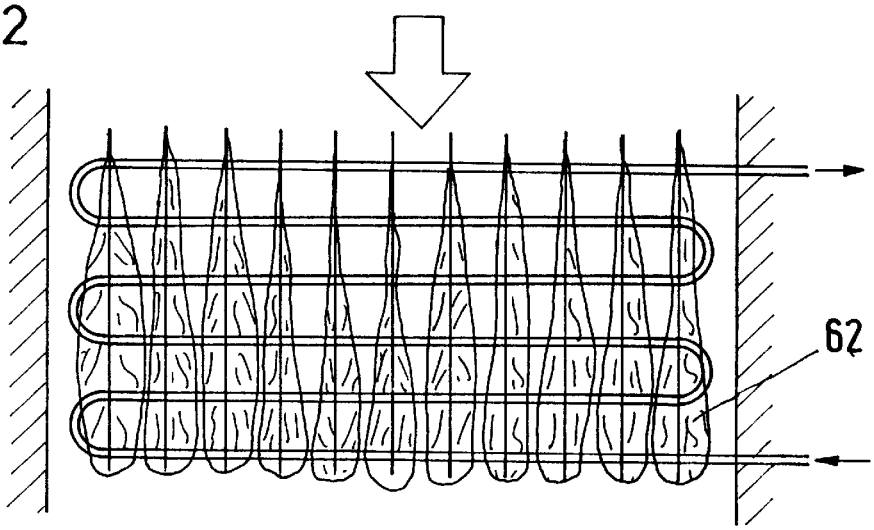
FIG. 12 shows the same cooling surface with an obstructive layer of frost.
Figure 13:
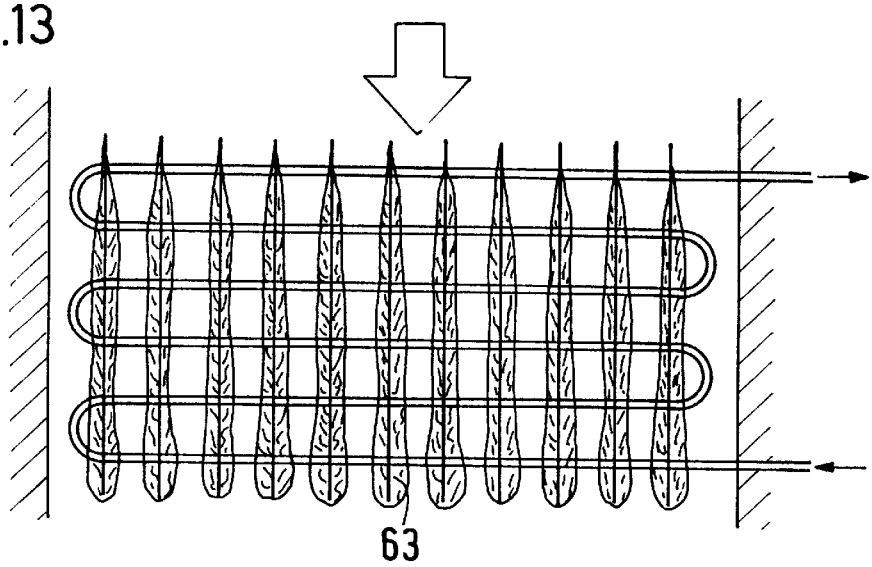
FIG. 13 shows the same cooling surface after partial defrosting.

FIGS. 11 to 13 illustrate a cooling surface 55 which is arranged in a refrigerating chamber 56. It has an evaporator coil 57 with numerous cooling fins 58. The refrigerant flows from the inlet 59 to the outlet 60. Air is blown through in counter-current as shown by the arrow 61.

FIG. 11 shows that a layer of frost 62 is starting to form at the lower ends of the fins 58. When this frost layer 62 reaches a thickness such as that shown in FIG. 12, the passage of air is greatly impeded. Partial defrosting is carried out, during which the frost layer melts and changes to a layer of ice 63. There is now again a sufficiently large cross-section for access of air. For the transfer of heat it is largely irrelevant whether the air delivers heat along the surface of the ice layer 63 or to the cooling surface itself. Only when the ice layer has become much thicker is full defrosting required.

The embodiments illustrated can be modified in many respects, without departing from the basic concept of the invention. For example, the intervals a and b can be dependent also on operating parameters of the refrigeration system other than the parameters mentioned. The duration c of partial defrosting can also, for example, be determined by measuring the air resistance in the vicinity of the cooling surface and determining the end of defrosting by a given value being fallen below. In the control unit 41 the four timers 44 to 47 are illustrated as individual blocks. Alternatively, they can be formed by a common computer with a suitable control program.

Defrosting is effected on an increase in temperature to above zero degrees. This can be caused either by an external influence, for example, heat transmission from the environment or heat emission from the goods to be cooled, or by the forced admission of heat to the cooling surfaces, for example, using hot refrigerant or hot saline solution or by electrical heating.

We claim:

1. A method for defrosting a refrigeration system, in which a supply arrangement supplies at least one cooling surface with refrigerant and a defrosting process is initiated at specific intervals, comprising the steps of carrying out partial defrosting at relatively short intervals and carrying out full defrosting at longer intervals, a plurality of said short intervals occurring before each long interval occurs.

2. A method according to claim 1, in which the shorter intervals are from one to two hours.

3. A method according to claim 1, in which the longer intervals are eighteen to thirty hours.

4. A method according to claim 1, in which full defrosting is carried out during a period in which the refrigeration system is normally least loaded.

5. A method according to claim 1, in which the interval between two defrosting processes is dependent on operating parameters of the refrigeration system.

6. A method according to claim 1, in which defrosting is effected by interrupting the supply of refrigerant to the cooling surface.

7. A method according to claim 6, in which an "on" time of the supply arrangement is monitored and when the shorter interval has been exceeded the supply arrangement is stopped until partial defrosting has been achieved.

8. A method according to claim 6, in which, when using a refrigerant system having several cooling surfaces and continuous supply of refrigerant, the supply to each cooling surface in succession is interrupted until partial defrosting has been effected.

9. A method according to claim 6, in which, in a refrigeration system having a secondary circuit with several cooling surfaces, the refrigerant of which is cooled by a primary circuit, partial defrosting is effected by interrupting the secondary refrigerant flow to one or more cooling surfaces.

10. A control unit for a refrigeration system having at least one cooling surface, an output for switching on and switching off a flow of refrigerant passing through the cooling surface in dependence on refrigerating chamber temperature, having a first switch-off timer which determines a shorter interval between a start of partial defrosting and an end of previous defrosting, a second switch-off timer which determines longer interval between a start of full defrosting and an end of previous full defrosting, a first switch-on timer which determines a shorter duration of partial defrosting and a second switch-on timer which determines a longer duration of full defrosting, and means for permitting a plurality of said shorter intervals before one of said longer intervals.

11. A control unit according to claim 10, including means for setting the two switch-off timers to fixed times.

12. A control unit according to claim 10, in which the two switch-on timers include means to respond to operating parameters of the refrigeration system.

* * * * *